United States Patent [19]

Vitale

[11] Patent Number: 4,662,542

[45] **Date of Patent: * May 5, 1987**

[54] SAFETY CLOSURE FOR AEROSOL CANS

[76] Inventor: Ralph A. Vitale, Post Office Box 15735, Sarasota, Fla. 33579

[ * ] Notice: The portion of the term of this patent subsequent to Mar. 18, 2003 has been disclaimed.

[21] Appl. No.: 742,435

[22] Filed: Jun. 7, 1985

Related U.S. Application Data

[63] Continuation-in-part of Ser. No. 609,512, May 10, 1984, Pat. No. 4,576,315.

[51] Int. Cl.[4] ..... B67D 5/32; B67D 5/06

[52] U.S. Cl. ..... 222/153; 222/182; 222/402.11; 220/85 P

[58] Field of Search ..... 222/182, 153, 402.11, 222/402.12; 215/220; 220/85 P, 281, 288

[56] References Cited

U.S. PATENT DOCUMENTS

| | | | |
|---|---|---|---|
| 437,062 | 9/1890 | Tyler . | |
| 746,466 | 12/1903 | Cornell . | |
| 2,560,211 | 7/1951 | Burdick . | |
| 3,162,329 | 12/1964 | Gregory | 220/85 P |
| 3,349,969 | 10/1967 | Velt . | |
| 3,460,708 | 8/1969 | Vollers | 222/182 X |
| 3,462,045 | 8/1969 | Markowitz . | |
| 3,514,011 | 5/1970 | Madeira et al. | 222/182 X |
| 3,724,724 | 4/1973 | Gach . | |
| 3,782,605 | 1/1974 | Messenger . | |
| 3,857,505 | 12/1974 | Mumford et al. . | |
| 3,863,814 | 2/1975 | Shelton . | |
| 3,892,326 | 7/1975 | Schreible . | |
| 3,915,348 | 10/1975 | Suhr | 222/153 |
| 4,024,988 | 5/1977 | Starrett . | |
| 4,130,220 | 12/1978 | McKirnan . | |
| 4,135,638 | 1/1979 | Wandl | 220/85 P X |
| 4,303,175 | 12/1981 | Lux . | |
| 4,353,483 | 10/1982 | Pehr . | |
| 4,457,445 | 7/1984 | Hanks et al. . | |
| 4,576,315 | 3/1986 | Vitale | 222/153 |

FOREIGN PATENT DOCUMENTS

| | | | |
|---|---|---|---|
| 959795 | 12/1974 | Canada | 206/85 P |

*Primary Examiner*—Joseph J. Rolla
*Assistant Examiner*—P. McCoy Smith
*Attorney, Agent, or Firm*—Roylance, Abrams, Berdo & Goodman

[57] ABSTRACT

A safety closure for an aerosol can including an externally screw threaded sleeve and a safety cap having internal threads to engage the threads on the sleeve. The sleeve may have a slit extending along one side thereof and an inwardly extending flange at its lower end. The flange is engageable below an upper peripheral rim of the aerosol can. The sleeve may include a disc which is positioned above the nozzle of the aerosol can and closes the opening of the sleeve. The sleeve is removed by flexing it until the flange is out of engagement with the peripheral rim of the aerosol can. Standard safety cap devices can be used with the invention sleeve.

12 Claims, 13 Drawing Figures

FIG.7
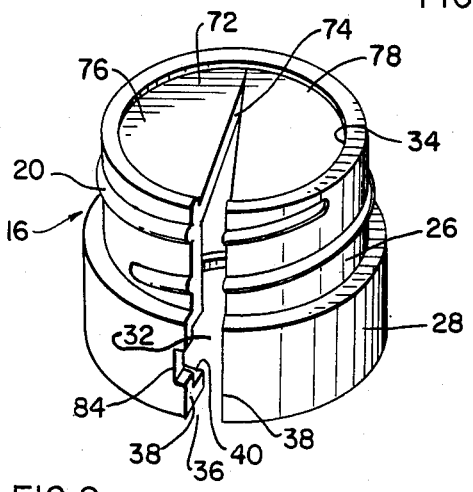
FIG.8
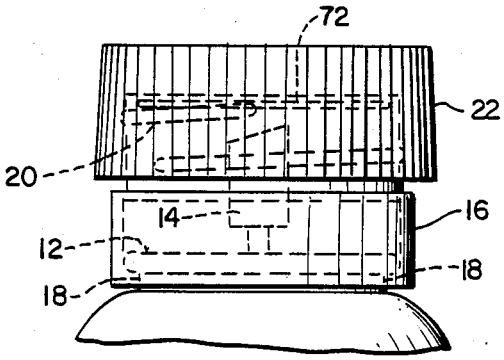
FIG.9
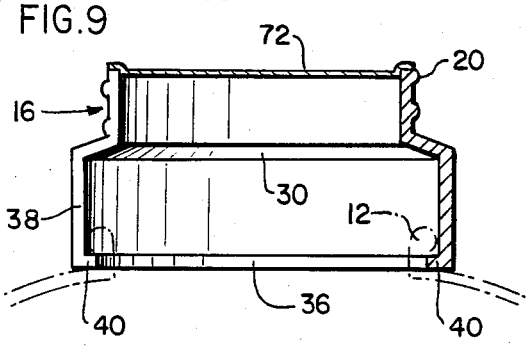
FIG.10
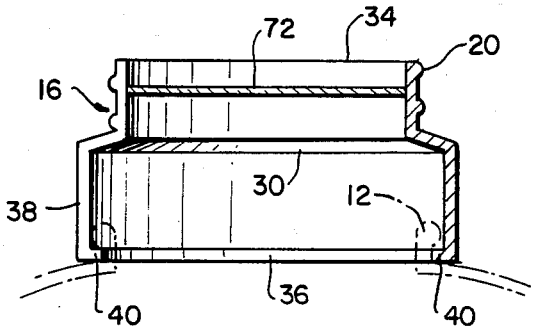
FIG.11
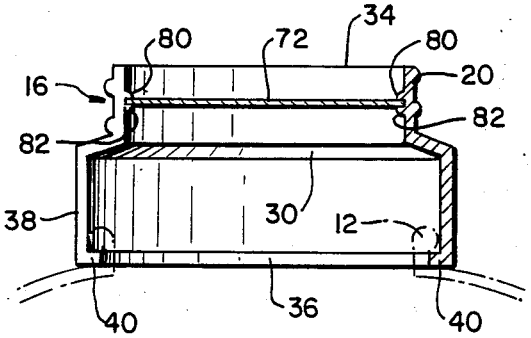
FIG.12
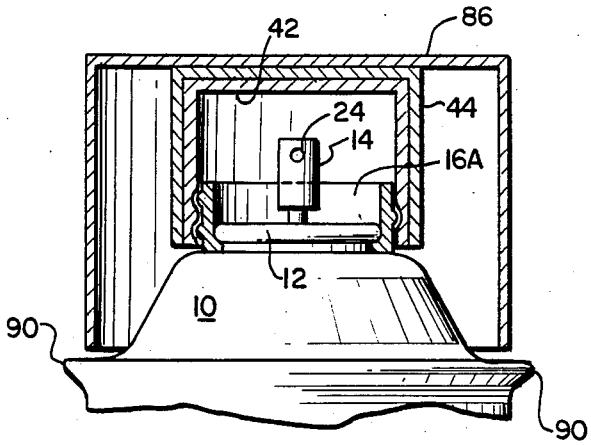
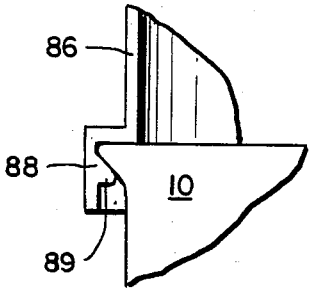
FIG.13

SAFETY CLOSURE FOR AEROSOL CANS

REFERENCE TO RELATED APPLICATION

This application is a continuation-in-part of U.S. patent Ser. No. 609,512, U.S. Pat. No. 4,576,315, filed May 10, 1984.

FIELD OF THE INVENTION

This invention relates to safety closures for aerosol cans, and to aerosol cans provided with such closures, to prevent or hinder inadvertent or unauthorized operation of the aerosol cans by children.

BACKGROUND OF THE INVENTION

Aerosol cans are well known for dispensing many products such as, for example, shaving cream, perfume, antiperspirants, insecticides, paint, etc. Some of these products are dangerous to children, and some are damaging to clothes, furniture, etc. if inadvertently dispensed thereon.

Child resistant closures for different types of containers, particularly medicine containers, are well known. Some of these are now inexpensive to manufacture and have obtained credibility with adults.

Many attempts have been made over the years to provide child resistant closures for aerosol cans, examples of such being disclosed in U.S. Pat. Nos. 3,349,969; 3,863,814; 4,130,220 and 4,353,483. However, there is still a need for a low cost child resistant closure for an aerosol can which is easy to operate by adults and has credibility with adults.

SUMMARY OF THE INVENTION

It is an object of the present invention to provide improved safety closures for aerosol cans.

One manner in which this is achieved is the employment of a slit sleeve, which can be snapped over the conventional peripheral rim of the aerosol can, and a safety cap which can be screwed onto this sleeve. The safety cap prevents the sleeve from being removed and can be of the type now found on medicine containers. This has the advantage of enabling medicine type safety caps to be used with aerosol cans, thus providing both credibility and low cost.

Accordingly, therefore, there is provided by the present invention a safety closure for an aerosol can having a conventional peripheral rim, comprising a sleeve having top and bottom openings with a slit extending along one side of the sleeve between these openings. The sleeve has externally thereon a screw thread, and has an inwardly extending flange at the bottom defining said bottom opening, whereby the flange can engage below the peripheral rim of the aerosol can after the sleeve has been flexed apart along its slit to enable the flange to pass over the aerosol can's rim. A safety cap having an internal screw thread is screwed onto the sleeve to prevent the sleeve from flexing apart along its slit and so lock the flange under the aerosol can's rim. The safety cap includes means for preventing the cap from being simply unscrewed from the sleeve without performing an additional safety operation.

The safety cap can be of the type used with medicine containers which require the cap to be pushed firmly downwards before it will unscrew.

Other manners of achieving the objects of this invention include the employment of a disc which is received by or made integral with the sleeve to close off the opening in the sleeve. The disc overlies the actuator of the aerosol can whenever the sleeve is on the can.

Also, the sleeve may be fixedly attached to the aerosol can and not include the slit. When the sleeve is fixedly attached to the can, the sleeve must be of a height to permit the actuator to spray the contents of the can to the exterior of the sleeve. Furthermore, it is not necessary that the safety cap be attached to the sleeve by threads. Other fastening methods and devices may be employed.

Other objects, features and advantages of the present invention will become more fully apparent from the following detailed description of certain embodiments, the appended claims and the accompanying drawings.

BRIEF DESCRIPTION OF THE DRAWINGS

FIG. 7 is a perspective view of a second embodiment of a sleeve which can be employed in accordance with this invention, this sleeve including a disc.

FIG. 8 is a partial side view of an aerosol can including the sleeve illustrated in FIG. 7.

FIG. 9 is a side view, in cross section for clarity, illustrating one disc and sleeve arrangement which can be employed in the practice of this invention.

FIG. 10 is a side view, in cross section for clarity, illustrating a second disc and sleeve arrangement which can be employed in the practice of this invention.

FIG. 11 is a side view, in cross section for clarity, illustrating a third disc and sleeve arrangement which can be employed in the practice of this invention.

FIG. 12 is a side view, in cross section for clarity, of another embodiment of this invention attached to an aerosol can.

FIG. 13 is a partial side view, in cross section for clarity, of a type of a decorator cap which can be employed in the practice of this invention.

DETAILED DESCRIPTION OF THE DRAWINGS

Figure 1:
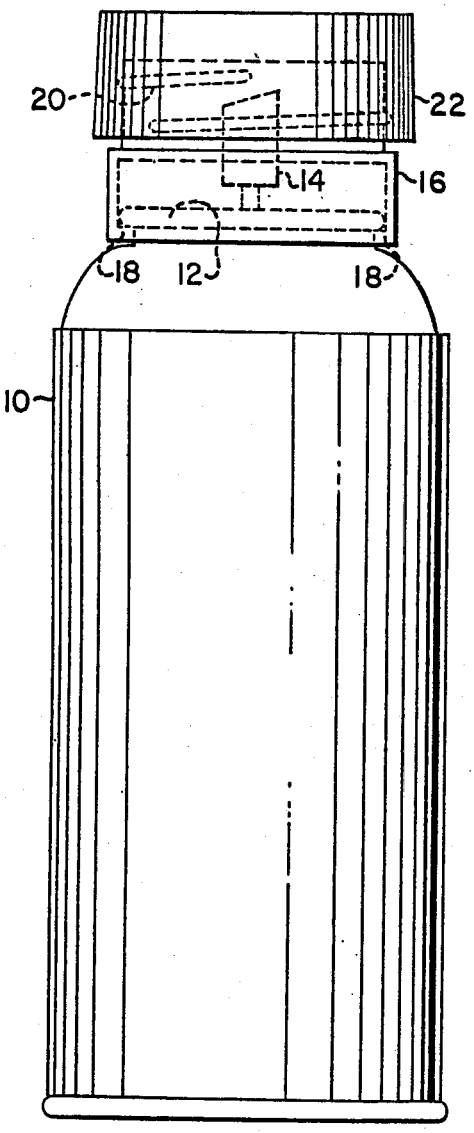
FIG. 1 is an elevational view of an aerosol can provided with a safety closure according to the present invention.

Referring to the Figures, FIG. 1 shows a conventional aerosol can 10 having a top peripheral rim 12 (in broken lines) and a dispensing valve member 14 (in broken lines) extending upwardly above the rim 12. A sleeve 16 has a flange 18 (in broken lines) at the bottom engaging below the rim 12. The upper portion of the sleeve 16 has an external screw thread 20 (in broken lines) on which is screwed a safety cap 22.

Figure 2:
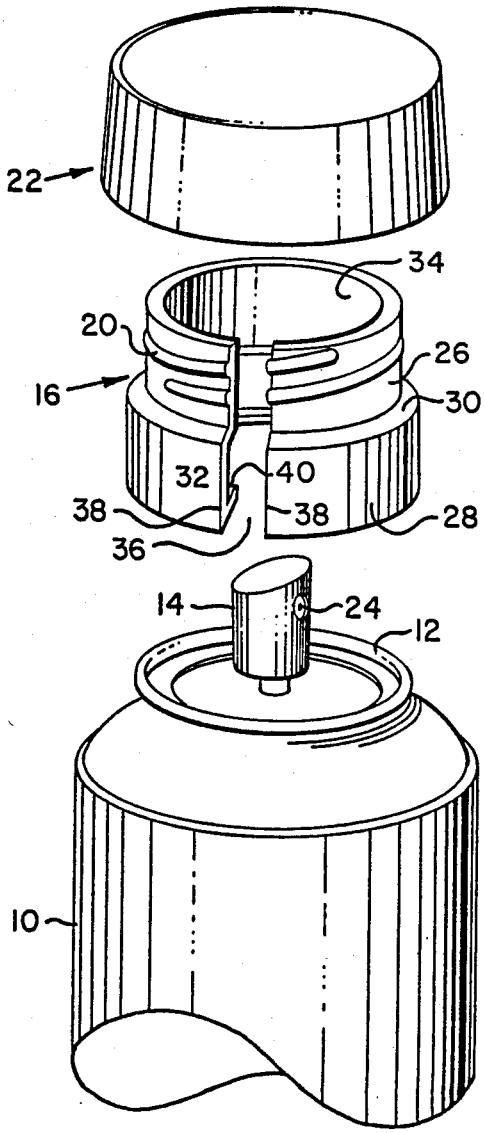
FIG. 2 is an exploded view of the cap, sleeve and aerosol can of FIG. 1.

FIG. 2 shows in exploded view the upper portion of the aerosol can 10, the sleeve 16 and the cap 22. The valve member 14 is disposed centrally of the rim 12 and has an orifice 24 through which an aerosol spray is dispensed by depressing or deflecting the valve member 14. The sleeve 16 is of generally cylindrical shape, having a continuous side wall and a smaller diameter upper portion 26 integrally connected to a larger diameter lower portion 28 by a connecting frusto-conical, flat annular or otherwise configured section 30. The screw thread 20 on the exterior of the upper portion 26 is interrupted by a vertical slit 32 extending down one side of the sleeve 16 from the top opening 34 thereof to the bottom opening 36 thereof, the slit 32 extending continuously through the upper cylindrical portion 26, the connecting section 30 and the lower cylindrical portion 28. The width of the slit 32 is shown exaggerated for clarity. The sleeve is injection molded from thermoplastic material, and is sufficiently resilient to allow the slit 32 to be flexed apart to increase the size of the openings 34, 36, but normally tends to close the slit so that the longitudinal edges 38 thereof are closely adjacent. Extending radially inwardly from the lower edge of the sleeve is a flange 40.

Figure 3:
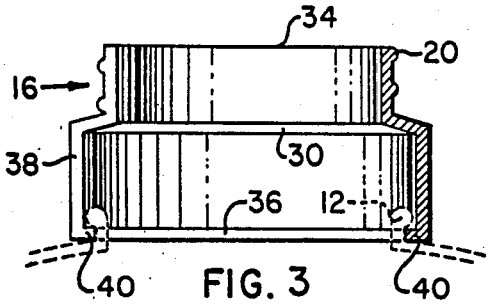
FIG. 3 is a vertical section of the sleeve of FIG. 2 taken through its slot and showing the peripheral rim of the aerosol can in broken lines.

FIG. 3 shows a vertical section of the sleeve 16 taken through the slit 32 and showing one longitudinal slot edge 38. The flange 40 can be seen engaging under the aerosol rim 12 (in broken lines) defining the bottom opening 36 of the can.

To assemble the components of FIG. 2, the sleeve 16 is flexed apart along the slit 32 to extend the flange 40 and enable it to pass over the rim 12, whereupon the outward flexing of the sleeve 16 is stopped and the flange 40 snaps under the rim 12 with the longitudinal edges 38 of the sleeve coming back together. While holding the lower portion 28 of the sleeve in one hand, the cap 22 is screwed tightly onto the sleeve 16 with the other hand. This screwing of the cap 22 onto the screw thread 20 ensures that the edges 38 of the slit 32 cannot flex apart, thus locking the flange 40 under the rim 12 to securely retain the sleeve in position.

Figure 4:
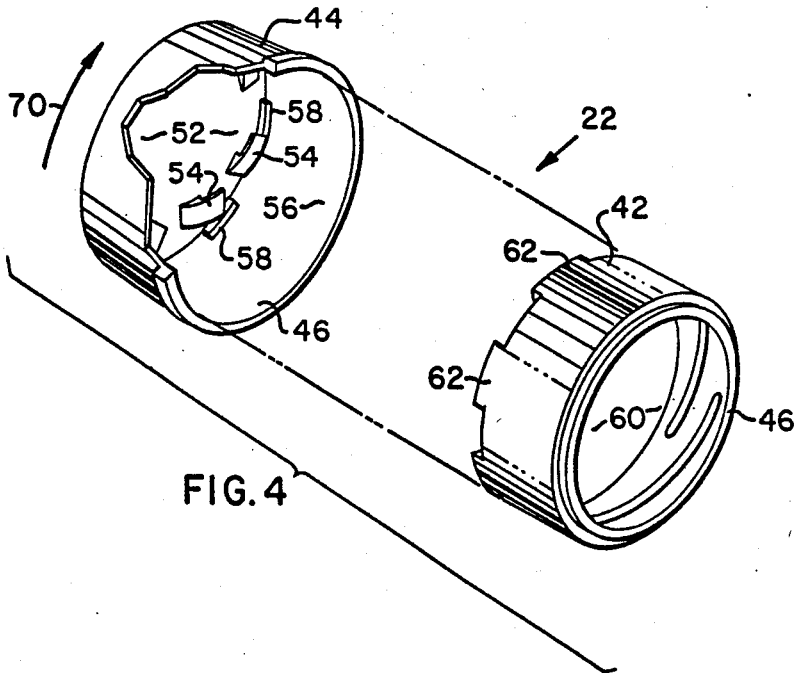
FIG. 4 is an exploded perspective view of the cap of FIGS. 1 and 2.
Figure 5:
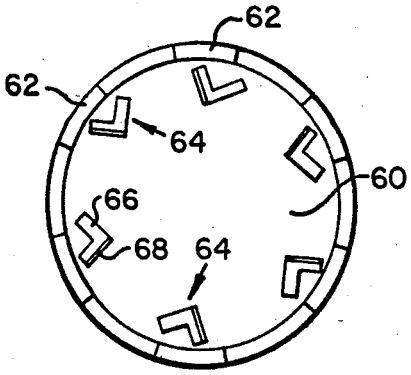
FIG. 5 is a top plan view of the inner member of the cap of FIG. 4.
Figure 6:
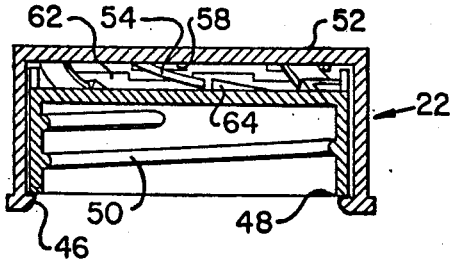
FIG. 6 is a vertical section of the cap of FIG. 4 when assembled.

FIGS. 4, 5 and 6 show further details of the safety cap 22.

FIG. 4 shows in exploded view, partly from below, the safety cap 22 having an inner cap 42 and an outer cap 44, both of which can be molded from thermoplastic material. As is shown in the vertical cross sectional view of FIG. 6, the inner cap is rotatably housed inside the outer cap 44 and is retained therein by a lower, radially inwardly extending flange 46 of the outer cap engaging below the lower edge 48 of the inner cap. The inner cap 42 has an internal screw thread 50 for engagement with the external screw thread 20 on the sleeve 16. On the inside of the top 52 of the outer cap are provided a circle of spaced apart, cantilevered resilient tongues 54. Radially outwardly of the tongues 54, and integral with both the top 52 and sidewall 56 of the outer cap 44 are a series of spaced apart stops 58. Around the periphery of the top 60 of the inner cap are a series of castellations 62. On the top 60, inside the castellations 62, are a series of ratchet teeth 64, the arrangement of which is shown in FIG. 5 and the profile of which can be seen in FIG. 6. Each ratchet tooth 64 has a ramp 66 and a vertical side 68. When the outer cap 44 is rotated in the direction of the arrow 70 in FIG. 4, the cantilevered tongues 54 flex and ride over the ramps 66 of the ratchet teeth 64 so that the outer cap rotates relatively to the inner cap 42 and the latter is not unscrewed from the sleeve 16. If the outer cap 44 is rotated in the opposite direction to the arrow 70, the free ends of the cantilevered tongues 54 engage against the vertical sides of the ramps 66 and cause the inner cap to rotate with the outer cap; thus either screwing the inner cap 42 onto the sleeve 16 or, if already screwed-on, further tightening the inner cap on the sleeve 16. However, if the outer cap 44 is firmly pushed down against the inner cap 42 and simultaneously turned in the direction of the arrow 70, the stops 58 engage between the castellations 62 in dog clutch manner and cause the inner cap to rotate in unison with the outer cap. In this way the safety cap 22 can be unscrewed and removed from the sleeve 16. For further details of the safety cap 22, reference is made to U.S. Pat. No. 3,857,505.

In use, the aerosol dispenser is stored with the safety cap 22 securely screwed onto the sleeve 16 which in turn has its lower flange 40 firmly engaged and locked under the rim 12 of the aerosol can. If a child tries to remove the safety cap 22 by simply turning the outer cap 44, then the outer cap will either further tighten the inner cap onto the sleeve 16, further rotation then rotating the sleeve 16 on the aerosol can, or the outer cap will rotate relative to the inner cap with a clicking sound as the tongues 54 flex over the ramps of the ratchet teeth 64. In either case the safety closure 22 will not come off regardless of whether or not the lower portion 28 of the sleeve 16 is gripped in one hand. When a trained person wishes to use the aerosol dispenser, the sleeve 16 is gripped in one hand, the outer cap 44 is gripped in the other hand and simultaneously pushed downwardly and rotated in the direction of the arrow 70 until the cap assembly 22 unscrews and disengages from the sleeve 16. The height of the sleeve, which is higher than the valve member 14, still prevents the aerosol spray from being activated. Next, the sleeve is flexed outwardly along its slit 32 to enable the sleeve flange 40 to be disengaged from and moved over the aerosol can's rim 12. The sleeve 16 can then be placed on a surface with the safety cap assembly 22 and the aerosol can is now ready for use by directing the orifice 24 at the target to be sprayed and depressing the valve member 14.

To again store the aerosol dispenser, the sleeve 16 is first snapped onto the aerosol can and then the safety closure again screwed onto the sleeve 16.

It will be appreciated, therefore, that the slit, threaded and flanged sleeve enables known types of child resistant closure caps to be employed with aerosol cans. Such closures are already in mass production thus reducing their cost. Further, the adult public is familiar with their mode of operation and has already accepted the credibility of this type of child resistant closure cap. The reduction in diameter of the upper portion 26 of the sleeve enables medicine type closure cap assemblies of normal dimensions for medicine bottles to be readily employed.

It will also be appreciated that the necessity of removing the resilient sleeve is a further safety feature.

Further embodiments of this invention are illustrated in FIGS. 7–13. The embodiments illustrated in FIGS. 7–11 are basically the same as the embodiment illustrated in FIGS. 1–6 except that embodiments include disc 72; FIGS. 12 and 13 are described below. Accordingly, in the description that follows, parts the same as or very similar to parts described above are designated by the same reference numerals.

Disc 72 fits within sleeve 16 and functions as a closure therein. In some embodiments, disc 72 is comprised of two identical half discs 76 and 78 which abut along their respective straight edges when sleeve 16 is closed, forming slit 74 between their respective straight edges. Slit 74 is in the same vertical plane as slit 32 in sleeve 16 so that the half discs 76 and 78 separate along slit 74 as sleeve 16 is opened.

Disc 72 can be positioned in various positions relative to sleeve 16 as illustrated in FIGS. 9–11. In FIG. 9, disc 72 is inserted in the top of sleeve 16. Disc 72 can either snap-fit in place, or adhesive can be employed to retain disc 72 in place.

In FIG. 10, as well as in FIGS. 7 and 8, disc 72 is positioned beneath top opening 34 and is either molded integral with sleeve 16 or is adhered to the inner surface of sleeve 16.

In FIG. 11, disc 72 is positioned in the same position as in FIG. 10. However, in this embodiment, the interior of sleeve 16 includes upper flange rim 80 and lower flange rim 82. Disc 72 is snapped into place between these rims 80 and 82. When disc 72 is designed to "snap" into place, disc 72 can either be a unitary member or can be comprised of half discs 74 and 76. In either design, disc 72 may be designed to fall out of or be removed from its fitting when sleeve 16 is flexed open, or it may be adhered or otherwise secured to one half of the sleeve 16.

Disc 72 is always positioned above nozzle 14 when sleeve 16 is in place and is thus an extra safety measure. Even if a child somehow manages to remove safety cap 22, the child will still not have access to actuator or nozzle 14 due to disc 72. In these embodiments, sleeve 16 must be removed before the child or any user can finally gain access to nozzle 14.

In some embodiments, (see FIG. 7), sleeve 16 may also include a notch 84. Notch 84 is located adjacent slit 32 and is provided as an aid in flexing sleeve 16 open. A pen, screwdriver, coin, or other small, thin object can be inserted in notch 84 and twisted, thus opening sleeve 16. Embodiments including notch 84 can be made of a stiffer material than embodiments not including notch 84. This is due to the fact that notch 84 enables one to use a mechanical aid to flex sleeve 16. This provides yet further protection against children gaining unauthorized access to nozzle 14. If sleeve 16 is made of a stiffer material, it requires more physical strength and thus becomes harder for a child to flex sleeve 16 open. Moreover, most children do not have the manual dexterity to insert a thin object into notch 84 to pry sleeve 16 open. In fact, such thin objects usually are not at a child's disposal, since these objects can be dangerous to children.

FIG. 12 illustrates yet another embodiment of this invention. This embodiment is designed to also fit on an aerosol can 10 having a peripheral rim 12 and also includes sleeve 16A and safety cap 22. However, in this embodiment, sleeve 16A is attached to peripheral rim 12 and is not designed to be removed from rim 12. Sleeve 16A is of such a height that the spray from spray nozzle 14 clears the top of sleeve 16A. Tests have shown that if the size and material of sleeve 16A are suitably selected, sleeve 16A can be secured in place for purposes of the invention by a friction fit alone. Of course, a suitable glue can be added to more securely hold it in place. Sleeve 16A need not necessarily be split, as is sleeve 16. Slight resiliency of the material, preferably a plastic, of sleeve 16A will permit it to be force fit over bead 12 to hold it in place by friction, as described above.

The embodiment illustrated in FIG. 12 includes a decorative cap 86 which is designed to enclose safety cap 22. If desired, outer cap 44 can be manufactured to be integral with decorative cap 86 or can be adhered to outer cap 44 in some manner.

The lower edge of cap 86 is spaced above the lower rim 90 of can 10 when caps 44 and 86 are proper installed on can 10 (see FIG. 12). This space is provided so that caps 44 and 86 can be pressed downward to remove cap 44 and 86 as desired.

FIG. 13 shows another embodiment of decorative cap 86. In this embodiment, decorative cap 86 has a lower annular ring 88 which has spaced beads 89 on its interior face. Beads 89 are designed to engage rim 90 to retain cap 86 on can 10. Any number of beads 89 may be employed, however, in one embodiment, four beads 89 are emploued spaced 90° apart.

With respect to all of the embodiments of this invention illustrated in the Figures, any type of connection can be employed to fasten safety cap 22 to sleeve 16. Also, any known child-proofing apparatus can be employed in safety cap 22.

While the invention has been described in detail above, it is to be understood that this detailed description is by way of example only, and the protection granted is to be limited only within the spirit of the invention and the scope of the following claims.

What is claimed is:

1. A safety closure for an aerosol can having a peripheral rim and an actuator, comprising:

a sleeve having bottom and top openings, a side wall and a disc, said disc closing said top opening;

said sleeve having an inwardly extending flange at the bottom of said sleeve which defines said bottom opening, said flange engaging the peripheral rim of the aerosol can to retain the safety closure on the can;

said sleeve having a slit which extends through the side wall and the disc;

wherein when said sleeve and disc are in engagement with the can, said disc overlies the actuator and prevents access thereto;

said sleeve and disc being designed and arranged such that said sleeve can be flexed to separate along the slit to remove the inwardly extending flange from the peripheral rim;

a safety cap;

fastening means for fastening the safety cap to the sleeve, and said safety cap including means for preventing removal of the safety cap from the sleeve.

2. A safety closure according to claim 1 wherein said fastening means includes an external thread on said sleeve and an internal thread on said safety cap, said threads being compatible.

3. A safety closure according to claim 2 wherein;

said disc is comprised of two half discs having straight edges, said straight edges being in and forming a part of a plane defined by said slit when said sleeve is attached to said can.

4. A safety closure according to claim 1 wherein said side wall of said sleeve includes a notch designed to receive a thin object, said notch being positioned adjacent the slit.

5. A safety closure according to claim 1 wherein said sleeve is cylindrical.

6. A safety closure according to claim 1 wherein the preventing means comprises:

an inner and an outer cap, said inner cap being rotatably mounted in said outer cap; and abutments on the interior of the outer cap and the exterior of the inner cap which may be brought into engagement by pressing down on the top of the outer cap, wherein when said abutments are in engagement and the outer cap is rotated in a predetermined direction, the safety cap can be removed from the can.

7. A safety closure according to claim 6 wherein said preventing means further includes:

a ratchet assembly having a series of resilient tongues mounted on one of the interior of the outer cap and the exterior of the inner cap, and ramps mounted on the other of the interior of the outer cap and the exterior of the inner cap;

said resilient tongues engaging the ramps when the outer cap is rotated and the abutments are not in engagement to prevent the removal of the safety cap.

8. A safety closure according to claim 1 wherein said disc is affixed to said sleeve by an adhesive.

9. A safety closure according to claim 1 wherein said disc is integral molded with said sleeve.

10. A safety closure according to claim 1 wherein the interior of the sleeve includes a pair of spaced rims, said disc being retained by said spaced rims.

11. A safety closure according to claim 1 wherein said disc fits snugly onto the top of said sleeve.

12. A safety closure according to claim 1 wherein said disc is positioned intermediate the openings in the sleeve.

* * * * *